United States Patent [19]

Focke

[11] 4,430,842

[45] Feb. 14, 1984

[54] PROCESS FOR APPARATUS FOR THE MANUFACTURE AND FILLING OF PACKAGES

[75] Inventor: Heinz Focke, Verden, Fed. Rep. of Germany

[73] Assignee: Focke & Co., Verden, Fed. Rep. of Germany

[21] Appl. No.: 250,791

[22] Filed: Apr. 3, 1981

[30] Foreign Application Priority Data

Apr. 15, 1980 [DE] Fed. Rep. of Germany ..... 3014392

[51] Int. Cl.[3] ..... B65B 11/10

[52] U.S. Cl. ..... 53/220; 53/228; 53/528

[58] Field of Search ..... 53/228, 528, 221, 210, 53/222, 436, 464, 465, 466

[56] References Cited

U.S. PATENT DOCUMENTS

| | | | |
|---|---|---|---|
| 1,114,053 | 10/1914 | Smith | 53/528 |
| 2,621,589 | 12/1952 | Dubois | 53/528 X |
| 3,212,230 | 10/1965 | Coates | 53/228 |
| 3,343,334 | 9/1967 | Bode et al. | 53/528 |
| 3,407,562 | 10/1968 | Nicola | 53/528 X |
| 3,683,586 | 8/1972 | Duckinsky et al. | 53/228 |
| 3,953,956 | 5/1976 | Massman . | |
| 3,986,319 | 10/1976 | Puskarz et al. | 53/228 X |
| 4,205,501 | 6/1980 | Michels | 53/228 |

*Primary Examiner*—Horace M. Culver

*Attorney, Agent, or Firm*—Sughrue, Mion, Zinn, Macpeak and Seas

[57] ABSTRACT

Packs 12 of coffee or the like centrally disposed on a carton blank 11 are pushed down into the mouth of a holder compartment 53 by a ram sensing plate 33 under predetermined pressure, which folds up the side walls 16, 17 of the blank in a U-shape. Pivot arms 41, 42 disposed on opposite upper sides of the compartment and having vertically spaced embossing edges 38, 39 at their ends are then moved inwardly to crease the side walls at the height of the compressed packs in cooperation with sharp edges 34, 35 of the sensing plate. The latter is then withdrawn, whereafter horizontally movable folding tools 51, 52 move in laterally to bend down and overlap the upwardly extending coverwall tabs 19, 20.

6 Claims, 5 Drawing Figures

PROCESS FOR APPARATUS FOR THE MANUFACTURE AND FILLING OF PACKAGES

BACKGROUND OF THE INVENTION

The invention relates to a method and apparatus for the manufacture and filling of a carton or package consisting of at least one foldable blank, which is wrapped around a group of individual packs in the region of its vertical side walls and an upper covering wall, a folding edge being formed between each of the side walls and the covering wall.

The packages consist of foldable material, especially paperboard, cardboard, etc., and the individual packs have above-average dimensional tolerances to enable them to be shaped within a certain range.

The packages include those intended to receive a plurality of individual packs containing loose goods, for example packs of roasted coffee. These are combined into larger selling units and constitute a block-like carton. This invention is concerned with encasing the packs only partially, namely in the region of a bottom wall, adjoining side walls and an upper covering wall. The bottom wall and a lower region of the side walls may constitute a rim or a tray of so-called tray pack. In such a configuration the bottom wall is provided, in the region of the end faces of the package which otherwise remain open with vertical rims which extend merely over a lower area of the individual packs.

A problem which is treated by the invention and which arises in the manufacture and filling of packages of this type lies in the inexact dimensions of the individual packs and of the block-like pack content formed from these. In individual cases, these dimensional tolerances of the packs lead to inadequate packages, in which the individual packs are not sufficiently retained.

SUMMARY OF THE INVENTION

Starting from this point, the object of the invention is to propose measures by means of which the different dimensions and, if appropriate, shapes of the packs are taken into account individually in the manufacture and filling of the package.

To achieve this object, the process according to the invention is characterized in that the height of the side walls is determined for each package by measuring the height of the packs, and the folding edges to delimit the side walls from the covering wall are made at an appropriate point of the blank.

Thus, the process according to the invention allows for different heights of the packs due to the fact that the conditions actually prevailing at any given time are ascertained by sensing, and the blank for manufacturing the package is adapted individually thereto. The height of the side walls, as the determining factor in the dimensions of the package, is fixed only after the actual height of the packs has been ascertained, namely by making a crease at an appropriate point. Then, by folding the blank in the region of these creases, the covering wall is formed from the tabs which overlap one another. Thus, if the packs have a height which is less than average, the creases for delimiting the side walls are formed at a lower point in accordance with the height dimension which was sensed. The same applies accordingly in the case of higher dimensions. As a result, each package has a height dimension exactly corresponding to the size of the packs.

According to the invention, uniform blanks which are always of the same size are folded from below around the packs in a U-shape, in such a way that, in an intermediate folding position, the side walls extend with the adjoining tabs in a vertical position. The height of the packs is then determined by sensing, and a crease is made in each side wall at an appropriate height. The tabs which are thus delimited from the side walls are thereafter folded over into the plane of the covering wall.

According to the invention, the sensing of the height of the packs can, at the same time, effect a compression shaping of the packs.

An apparatus for carrying out the process is equipped with a sensing and embossing unit which is brought into contact with the packs, the blank being brought into the intermediate creasing position. The sensing and embossing unit is equipped with a ram having a sensing plate which is lowered onto the packs. The creases are then made in the side walls at the height of the sensing plate by means of the sharp edges of the sensing plate interacting with embossing tools located on the opposite side of the blank. Thereafter, the sensing and embossing unit is withdrawn upwardly. Folding tools which are mounted laterally approximately at the height of the creases then turn the tabs over into the plane of the covering wall.

During the downward movement the sensing plate is lowered at a predetermined pressure onto the packs to ascertain to establish the height of the latter, so that if the pack contents are deformable a compression shaping takes place. Only in the lower end position is the crease made in a plane corresponding to the compressed pack content.

DETAILED DESCRIPTION OF THE PREFERRED EMBODIMENT

Figure 1:
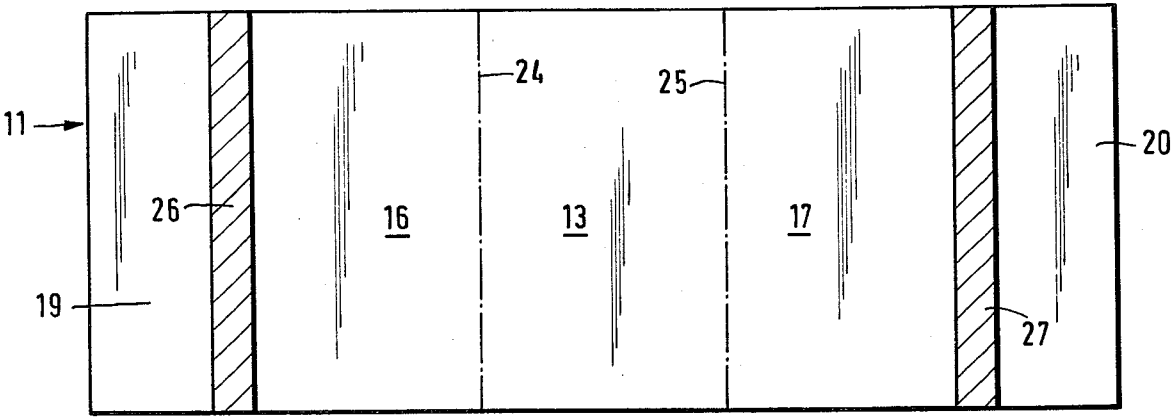
FIG. 1 shows a blank embodiment for the manufacture of a package, in a flat, spread-out position.
Figure 5:
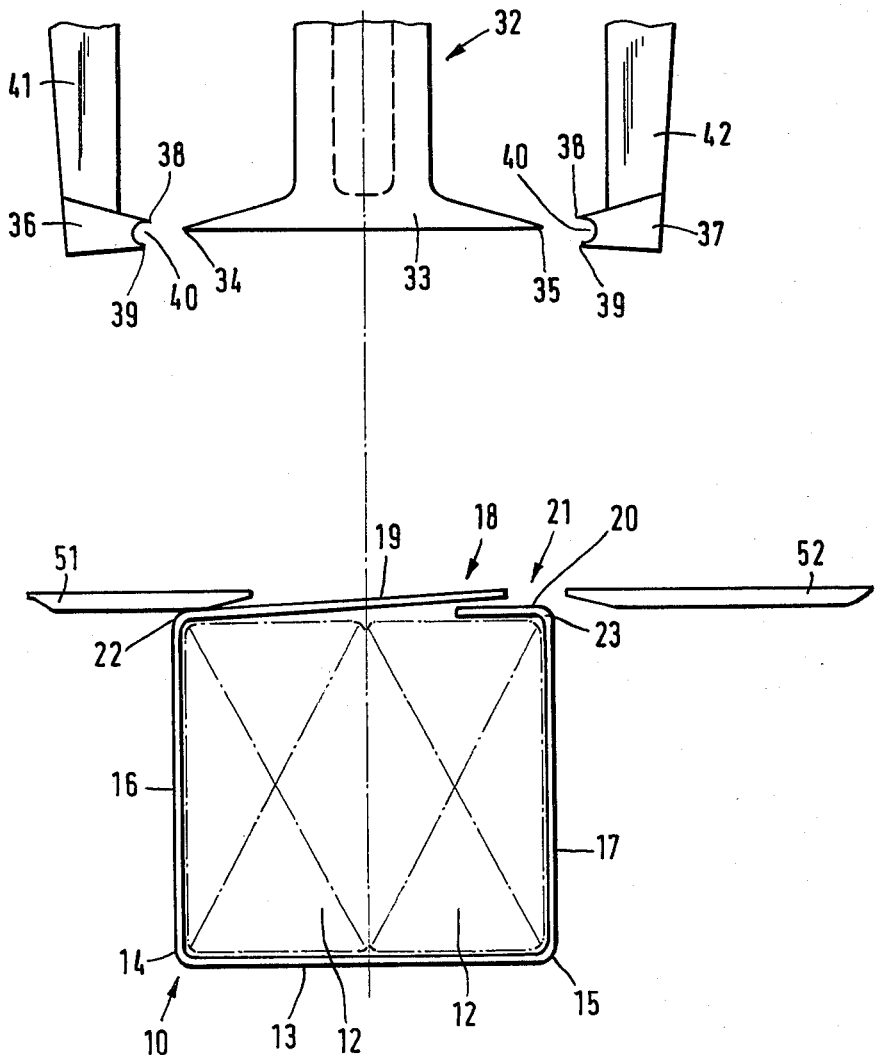
FIG. 5 shows details of the apparatus in a changed position.

In the embodiment represented in the drawings a package 10 consists of a rectangular blank 11 in one piece, which is illustrated in FIG. 1 in a spread-out state. This blank 11 encloses the pack content, a group of several individual packs 12, in the manner of an overlapped tubular wrapper (FIG. 5). The packs 12 stand on a bottom wall 13 formed by the blank 11, against vertical side walls 16 and 17 delimited from one another by folding edges 14, 15. The top side of the package 10 is formed by a covering wall 18 which consists of tabs 19 and 20 adjoining the side walls 16 and 17. Said tabs are folded with an overlap 21 which differs in size from case to case, and are connected to one another in the region of this overlap. In the embodiment shown in FIG. 5 the tabs 19, 20 are of different widths so that the overlap 21 lies off-center.

The uniform blank 11 of FIG. 1 is used universally for manufacturing the packages 10. Adaptations to different dimensions of the packs 12, namely to its height, are effected by correspondingly different dimensions of the height of the side walls 16 and 17 and correspondingly adapted dimensions of the tabs 19, 20. These are delimited from the side walls by folding edges 22, 23.

The dimension of the bottom wall 13 of the blank is fixed by pre-embossed creases 24, 25 which serve to form the folding edges 14 and 15. The upper folding edges 22, 23 are likewise formed in the region of a crease which is made on the inside of the blank 11, which is not fixed, in the present case, but is made individually in accordance with the height of the packs 12. In view of the different possible tolerances, the creases to form the folding edges 22, 23 lie within strip-shaped crease regions 26, 27.

The apparatus for manufacturing a package 10 with the abovmentioned features comprises a sensing and embossing unit 28. This determines the effective height of the packs 12 by sensing and then, at an appropriate height within the regions 26, 27, makes the creases to form the folding edges 22, 23.

For this purpose the sensing and embossing unit 28 is vertically adjustable on stationary guide rods 29. The upward and downward movements along the guide rods 29 are effected by a pressure cylinder, not shown in detail, the piston rod 30 of which is connected to an upper yoke 31.

Figure 4:
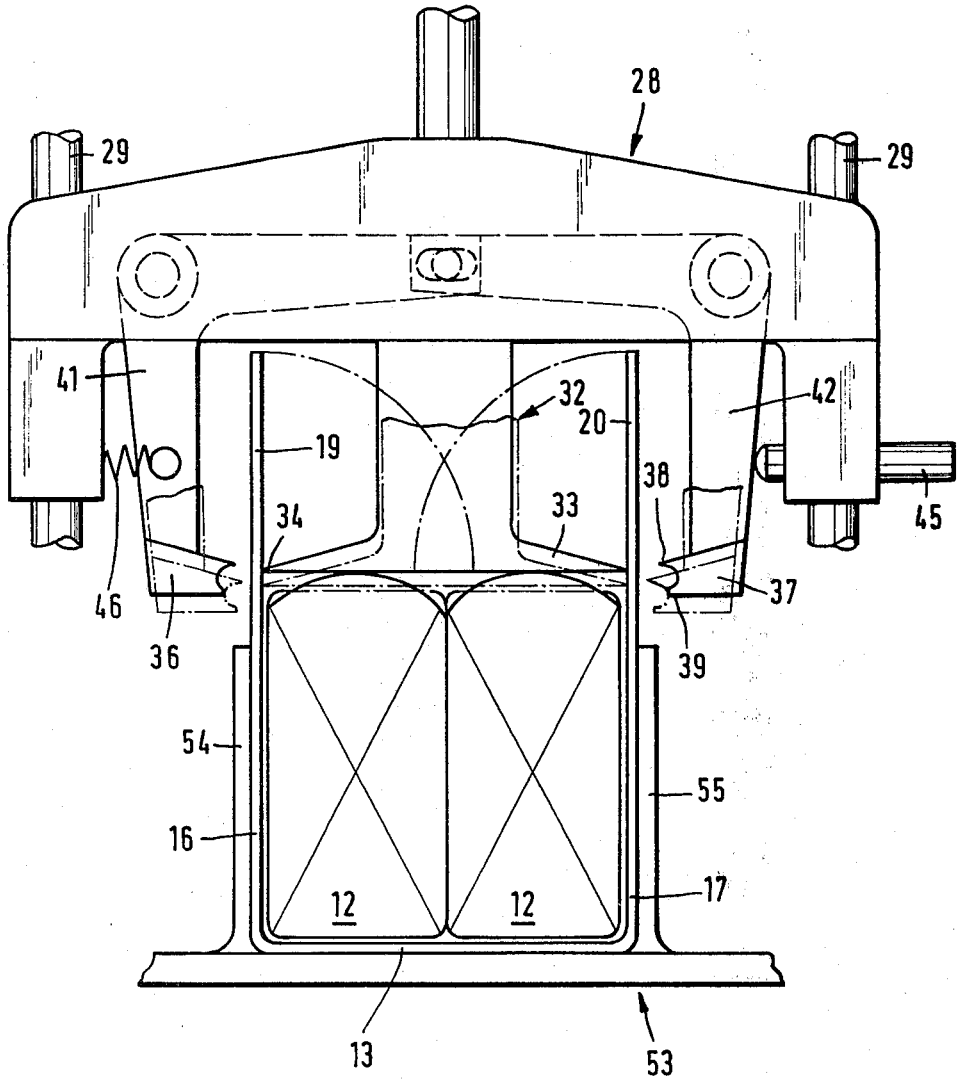
FIG. 4 shows a detail of the apparatus according to FIGS. 2 and 3, in a side view.

Attached centrally to this is a sensing ram 32, which can be lowered into contact with the partially folded package 10 or the packs 12. During this action a sensing plate 33 constituting the lower part of the ram 32 is lowered onto the top side of the packs 12, which are exposed. In so doing the sensing plate 33 bears on the packs with a certain pressure so that a shaping effect is exerted, as is evident from FIG. 4. The individual packs 12, which are shown as being curved upwards, are levelled by the sensing plate 33 so that the package content is shaped as a cuboid.

The creases for the folding edges 22, 23 are formed in the regions 26, 27 in the lower position of the sensing plate 33, at the height of the packs. For this purpose special embossing tools are located on the unit 28. The sensing plate 33 constitutes an inner part of the embossing tools, by means of its sharp outer edges 34 and 35. These edges are pressed into the blank 11 by the application of pressure to the blank on the opposite, outer side, to form a crease.

The outer embossing tools consist of pressure bars 36, 37 each having two spaced edges 38 and 39. The pressure bars 36, 37 undergo transverse movement externally against the blank 11, in such a way that the edges 38, 39, which are delimited from one another by a concavity 40, are vertically brought to bear on the blank on both sides of or flanking the embossing edges 34, 35. Consequently, the edges 34, 35 act on the inside, in the region of the concavity 40, and forms a crease.

The edges 38 and 39 of the pressure bars 36 and 37 are of different sizes such that the upper edges 38 project further inwardly. As a result, by the outer edges 38 and 39 being brought to bear on the blank 11 and by the inner edges 34, 35 acting as counter points, the projecting wall tabs 19, 20 of the blank are brought into a prefolding position in an inclined plane (shown by dot-and-dash lines in FIG. 2). The subsequent folding operation is thereby made easier.

The pressure bars 36, 37 are attached to pivoting arms 41, 42 which are, in turn, located by bearings 43, 44 on the yoke 31. The arms 41, 42 are stressed by a common actuating member, namely by a thrust bolt 45. This moves the pivoting arms 41, 42 in opposite directions against a tension return spring 46. The spring biases the arms toward their initial position, at which they bear against an adjustable stop pin 47.

Only one pivoting arm 42 is stressed by the thrust bolt 45. Its movement is transmitted to the other pivoting arm 41 via connecting arms 48, 49 and a coupling joint 50. The same applies to the effect of the return spring 46, which acts upon the pivoting arm 41.

Figure 2:
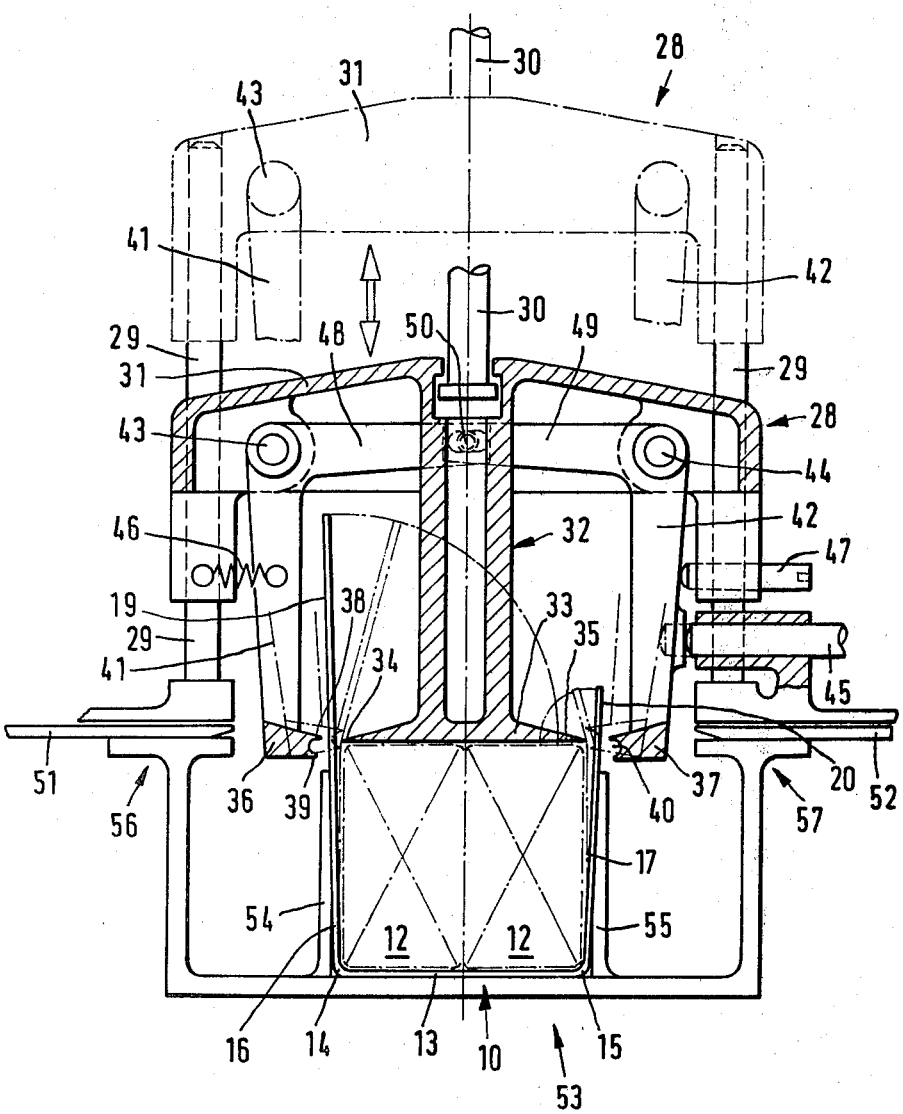
FIG. 2 shows a side sectional view of an apparatus for the manufacture and filling of packages consisting of a blank according to FIG. 1.
Figure 3:
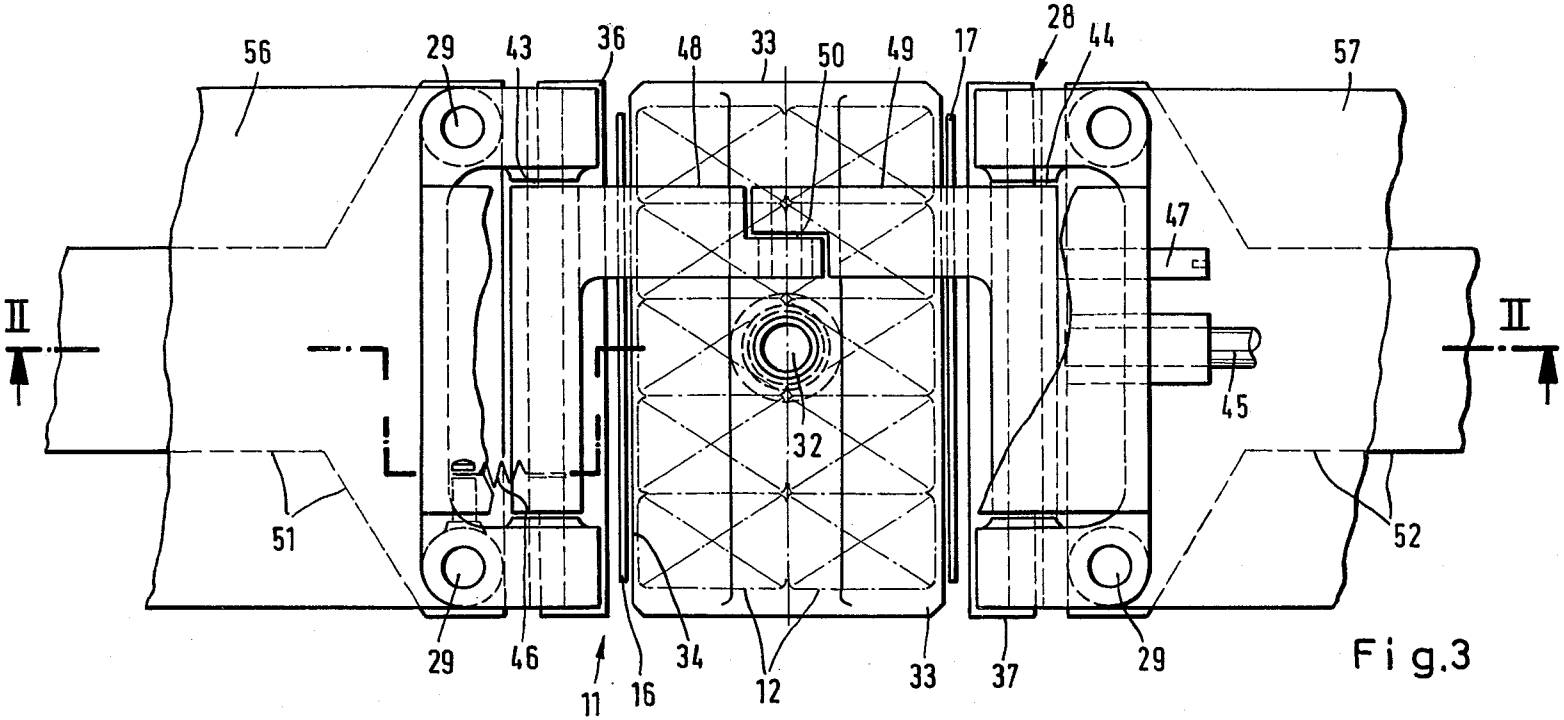
FIG. 3 shows a plan view of the apparatus according in FIG. 2.

After ascertaining the height of the packs 12 and after subsequently making the creases for the folding edges 22, 23, the sensing and embossing unit 28 is moved back into its upper initial position shown by dot-and-dash lines in FIG. 2 or as in FIG. 5. Fixedly mounted and transversely movable folding tools 51 and 52 are now moved in from the sides of the package 10 in a plane just above the creases formed. As a result, the wall tabs 19, 20, which are in the prefolded position, are folded over until they rest against one another and on the packs 12 (FIG. 5).

During the time in which the above-described folding operations are carried out, the package 10 is accommodated in a mouthpiece-like holder 53 which holds the package 10 laterally in the region of the side walls 16, 17 by means of vertical support wall 54 and 55. As seen in FIG. 2, the inner spacing of the support walls 54, 55 from one another in the upper region can be greater than the outer dimension of the package 10, so that the side walls 16, 17 and the tabs 19, 20 adjoining them have a certain latitude of movement.

By the use of the holder 53, the manufacture of the package 10 in its intermediate folded position can be carried out by first providing the unfolded flat blank 11 in a plane above the holder 53 and the support walls 54, 55. The pack content is then supplied and deposited on the bottom wall 13 of the unfolded blank 11. The sensing and embossing unit 28 is then moved downwardly out of the upper initial position shown by dot-and-dash lines in FIG. 2. During this movement the ram 32 and its sensing plate 33 press the packs 12, and in so doing carry the blank 11 along into the holder 53 and fold it in a U-shape, thus providing the intermediate folding position described. Immediately after this position is reached, the pack height can be sensed and the upper creases embossed.

The holder 53 and the vertical guide rods 29 constitute a unit appliance, which also includes lateral guides 56, 57 for the folding tools 51, 52.

What is claimed is:

1. An apparatus for folding a carton blank (11) around a plurality of individual packs (12), comprising:

(a) first means for folding a carton blank in a U-shape around a plurality of individual packs arranged thereon to define upstanding opposite side walls (16, 17) extending into cover tabs (19, 20), (b) means for vertically compressing the contents of the packs under predetermined pressure to establish the height thereof, (c) means for horizontally creasing the upstanding side walls to define folding edges (22, 23) thereon at a height corresponding to the established height of the compressed packs, and (d) second means for folding in the cover tabs at said creased edges over the tops of the compressed packs in an overlapping manner, wherein the means for compressing comprises a vertically movable, horizontal sensing plate (33), wherein the creasing means comprises two pairs of vertically spaced embossing edges (38, 39) individually disposed outwardly of the side walls and movable laterally inwardly into creasing engagement therewith, said sensing plate having sharp edges (34, 35) on opposite sides thereof cooperable with said embossing edges to form said folding edges, and wherein said sensing plate adjoins a vertically upstanding ram member (32), wherein said embossing edges are defined on lower ends of crank arms (41, 42) pivotally mounted to said ram member, and wherein upper ends of said crank arms are pivotally joined for simultaneous movement.

2. An apparatus for folding a carton blank (11) around a plurality of individual packs (12), comprising:

(a) first means for folding a carton blank in a U-shape around a plurality of individual packs arranged thereon to define upstanding opposite side walls (16, 17) extending into cover tabs (19, 20), (b) means for vertically compressing the contents of the packs under predetermined pressure to establish the height thereof, (c) means for horizontally creasing the upstanding side walls to define folding edges (22, 23) thereon at a height corresponding to the established height of the compressed packs, and (d) second means for folding in the cover tabs at said creased edges over the tops of the compressed packs in an overlapping manner, wherein the means for compressing comprises a vertically movable, horizontal sensing plate (33), wherein the creasing means comprises two pairs of vertically spaced embossing edges (38, 39) individually disposed outwardly of the side walls and movable laterally inwardly into creasing engagement therewith, said sensing plate having sharp edges (34, 35) on opposite sides thereof cooperable with said embossing edges to form said folding edges, and wherein each pair of embossing edges straddles a cooperating sharp edge of said sensing plate, and wherein an upper one of each pair of embossing edges extends further outwardly than a lower one of said embossing edges.

3. An apparatus according to claim 1 or 2, wherein said second folding means comprises a pair of planar folding plates (51, 52) individually disposed outwardly of the side walls and movable laterally inwardly in the vicinity of said folding edges.

4. An apparatus according to claims 1 or 2, further comprising a U-shaped holder compartment (53), wherein said sensing plate is disposed above an upwardly facing mouth of said compartment, and wherein the width of said sensing plate is slightly less than the width of said compartment and corresponds to the interior width of said U-shaped folded blank.

5. An apparatus according to claim 2, wherein said sensing plate adjoins a vertically upstanding ram member (32), wherein said embossing edges are defined on lower ends of crank arms (41, 42) pivotally mounted to said ram member, and wherein upper ends of said crank arms are pivotally joined for simultaneous movement.

6. An apparatus according to claim 1, wherein each pair of embossing edges straddles a cooperating sharp edge of said sensing plate, and wherein an upper one of each pair of embossing edges extends further outwardly than a lower one of said embossing edges.

* * * * *